United States Patent [19]

Sako et al.

[11] Patent Number: 4,703,431

[45] Date of Patent: Oct. 27, 1987

[54] SLIVER DRAWING APPARATUS

[75] Inventors: Shizuka Sako, Kasugai; Kanetoshi Amaike, Kani; Youji Watanabe, Kasugai, all of Japan

[73] Assignee: Chuba Seiko Co., Ltd., Kasugai, Japan

[21] Appl. No.: 915,875

[22] Filed: Oct. 8, 1986

Related U.S. Application Data

[63] Continuation of Ser. No. 646,122, Aug. 31, 1984, abandoned.

[30] Foreign Application Priority Data

Sep. 5, 1983 [JP] Japan ..... 58-163013
Sep. 5, 1983 [JP] Japan ..... 58-163014

[51] Int. Cl.[4] ..... G06F 15/46; D01H 5/32

[52] U.S. Cl. ..... 364/470; 19/240; 19/300; 318/625

[58] Field of Search ..... 364/470; 19/105, 239, 19/240, 300; 28/248, 251; 57/264, 265, 81; 73/160; 318/625

[56] References Cited

U.S. PATENT DOCUMENTS

| | | | |
|---|---|---|---|
| 3,822,590 | 7/1974 | Tharpe et al. | 19/240 |
| 3,922,642 | 12/1975 | Tooka | 364/470 |
| 4,100,649 | 7/1978 | Erismann et al. | 19/240 |
| 4,137,487 | 1/1979 | Niestroj et al. | 19/240 |
| 4,163,927 | 8/1979 | Grice, Jr. | 19/240 |
| 4,199,844 | 4/1980 | Goetzinger | 19/240 |
| 4,302,968 | 12/1981 | Moser | 19/239 |
| 4,364,002 | 12/1982 | Suzuki et al. | 364/470 |
| 4,369,550 | 1/1983 | Meile | 19/240 |
| 4,408,447 | 10/1983 | Sloupensky et al. | 364/470 |
| 4,414,495 | 11/1983 | Sumi et al. | 318/625 |
| 4,473,924 | 10/1984 | Hartmannsgrubes et al. | 364/470 |
| 4,494,203 | 1/1985 | Suzuki et al. | 364/470 |
| 4,494,204 | 1/1985 | Hösel | 364/470 |
| 4,506,413 | 3/1985 | Leifeld | 19/300 |

FOREIGN PATENT DOCUMENTS

| | | |
|---|---|---|
| 2544029 | 4/1977 | Fed. Rep. of Germany . |
| 2506345 | 11/1982 | France . |
| 2081758 | 2/1982 | United Kingdom . |

*Primary Examiner*—Jerry Smith
*Assistant Examiner*—John R. Lastova
*Attorney, Agent, or Firm*—Oblon, Fisher, Spivak, McClelland, & Maier

[57] ABSTRACT

A spinning machine, especially a drawing frame comprising at least a pair of feed rollers provided at a fiber working portion for carding at least one sliver and for feeding said sliver to be carded and drafted, at least one first motor for driving said feed rollers, at least a pair of front rollers for drawing out and feeding said sliver just carded at the fiber working portion, at least one second motor for driving the front rollers, and an electronic rotation control unit for controlling the rotations of the two different motors so as to synchronize the rotation of the first motor with the rotation of the other motor, i.e. the second motor and to be equal to a predetermined set rotational speed ratio. With this construction according to the present invention, gear change can be dispensed with when modifying the draft rate, and the change of the draft rate can be promptly performed. In addition, in the particular embodiment according to the present invention, the electronic rotation control unit can be realized by use of a microprocessor having a ROM and a RAM as well as a CPU so that the rotation control of the various motors for controlling the feeding rollers, a gill box, and the front rollers as well as soft start/stop control can be carried out by the microprocessor.

9 Claims, 16 Drawing Figures

SLIVER DRAWING APPARATUS

This application is a continuation of application Ser. No. 646,122, filed on Aug. 31, 1984, now abandoned.

BACKGROUND OF THE INVENTION

1. Field of the Invention

The present invention relates to a spinning machine, especially to a drawing frame which is one kind of spinning machines and it is utilized as a machine for carding raw materials such as wool, and the like in the form of one or plural slivers and for preparing another new sliver or slivers by carrying out the draft thereof.

2. Description of the Related Art

Conventionally, when spinning a raw material for yarn, such as wool, the entangled or twisted wool is firstly rinsed and then dried. The wool thus dried is unravelled by a machine called a carding machine and it is made into a batch of fibers called a sliver. Then, a sliver or slivers are put together and are drafted while carding the sliver or slivers by a drawing frame having a unit for carding called a gill box and then a new sliver is spin thereby.

Furthermore, the sliver thus prepared is again applied to the drawing frame and the carding and drafting processes are repeated. In this case, if necessary, the sliver is glossed, and string of yarn is finally formed.

One example of the structure of the drawing frame for carding and drafting, according to the prior art, is shown in FIG. 1. The drawing frame comprises a pair of feed rollers 1, a pair of front rollers 2, a plurality of rotating combs 3*a* as shown in FIG. 2 or a plurality of laterally moving combs 3*b* as shown in FIG. 3, which are arranged in a gill box 3 located between the feed rollers 1 and the front rollers 2 for carding. In this case, the speed for carding a sliver 4 within the gill box 3 is equal to to the feeding speed of the pair of feed rollers 1 for feeding the sliver 4 to the gill box 3. On the other hand, the feeding speed of the pair of front rollers 2 which feed the sliver 4, which is discharged from the gill box 3, is determined in accordance with a predetermined draft rate. For instance, the ratio of the carding speed in gill box 3 and rotational speed of the pair of front rollers 2, which is same as the feeding speed of the pair of feed rollers 1, is 5:1, if the draft rate is 5.

Accordingly, supposing that a sliver 4 having the weight of 50 g per meter is passed by the drawing frame 9, it is to be drafted into a sliver having the weight of 10 g per meter. Moreover, the drawing frame further comprises an unevenness detector 5 for detecting unevenness of the sliver 4, which is provided upstream of, and close to, the pair of feed rollers 1 and a mechanical memory 6 for storing information about unevenness detected by the detector 5.

The drawing frame further includes a drive motor M for driving the pair of feed rollers 1, the pair of front rollers 2 and the combs 3*a* or 3*b* in the gill box 3 through gears 7 and pulleys 8. When operating the drawing frame, the pair of feed rollers 1, the pair of front rollers 2 and the combs 3*a* or 3*b* in the gill box 3 start rotating simultaneously, and they are accelerated to a predetermined speed, while maintaining a constant draft rate so as to prevent the sliver 4 from being cut, or prevent the sliver from being jammed within the gill box 3. Moreover, when stopping the drawing frame, the feed rollers, the front rollers, and the combs are decelerated until they are stopped simultaneously, while the draft rate is maintained constant.

It is necessary for the draft rate of the drawing frame 9 to be changed in accordance with the nature of raw materials used, products to be made, and process, etc. Accordingly, the draft rate is normally adjustable by interval of 0.15 within the draft rate of 1 to 10. Conventionally, in this case, since about twenty gears had to be displaced, much time was required for changing gears, and the efficiency of the work was not necessarily good. In addition, it was difficult in practice to adjust the draft rate by the interval of 0.15 within the predetermined draft range by use of only gears 7 and the pulleys 8. Moreover, in order to correct unevenness the drawing frame 9 according to the prior art comprises an expensive stepless speed change gear 10 between the drive motor and that pair of front rollers 2 so as to carry out a fine adjustment thereof. Information relative to an uneven part of the sliver 4 which has been stored in the mechanical memory 6 is converted into a signal to change the transmission ratio or speed change ratio of the stepless change gear 10 via a hydraulic actuator 12 supplied with pressure oil through a controll valve 11, when the unevenness reaches the front rollers 2.

However, since the mechanical memory 6 as shown in FIG. 4 as well as the stepless speed change gear 10 is used in the drawing frame 9 according to the prior art, the allowance range of the adjustment of thickness will be within ±25%; therefore, the response characteristic of the machine is low. For instance, in a high speed drawing frame for carding, it is difficult to correct an unevenness of the sliver 4 having an length of less than 1 meter, and there is a drawback such as the normal portion downstream of the uneven part of sliver 4 is made irregular, due to the delay in control.

This is because a number of pins 6*c* in the mechanical memory 6 are provided at circular guides 6B which rotate together with a rotational shaft 6A which also rotates in synchronization with the pair of feed rollers 1, in such a manner that the number of pins c slide in the direction of a shaft paralleled with the rotational shaft 6A, and a lever 6D for pushing the pins is moved left and right in FIG. 4 by the operation of the unevenness detector 5. As a result, the pins 6*c* are slid and deviated, thus memorizing the unevenness of the sliver 4. When the deviated portion is moved or travelled to a predetermined position in accordance with rotation of the rotational shaft 6A, the degree of the slid deviation is picked up by a pin follower 6E, and the control valve 11 is operated thereby. Some propagation delay time inevitably occurs when signals are transmitted from the mechanical memory 6 to the control valve 11, and then to the hydraulic actuator 12 and finally to the stepless speed change gear 10 with the construction according to the prior art. This propagation delay time results in the delay in response in the high speed drawing frame 9 according to the prior art.

SUMMARY OF THE INVENTION

It is therefore a main object of the present invention to provide an improved spinning machine, in particular a drawing frame in which the gear change can be dispensed with when changing the draft rate, and yet the drawing frame can correct the unevenness of a sliver at a desired draft rate, and card the sliver.

It is another object of the present invention to provide a spinning machine in which a pair of or pairs of feed rollers and a pair or pairs of front rollers are driven independently by different motors for controlling the rotational speed thereof respectively, while detecting and storing information about unevenness of the sliver or slivers to be carded and drafted into a memory, and the rotational speed ratio of the feed rollers and the front rollers is changed accurately in accordance with the information stored in the memory.

It is another object of the present invention to provide a spinning machine in which carding and drafting of the sliver or slivers can be carried out at different draft rate in one drawing frame, and the change of the draft rate can be promptly done without changing gears, in contrast to drawing frames according to the prior art.

It is still another object of the present invention to provide a spinning machine in which a wide range of slivers having short or long uneven parts, and unusually thick or unusually thin silvers are correctable continuously, therefore slivers of good quality can be produced.

It is still another object of the present invention to provide a spinning machine having a gill box with pairs of feed rollers and pairs of front rollers, which enables a plurality of slivers to be carded and drafted by one spinning machine at different draft rates.

It is still further object of the present invention in to provide an electronic microprocessor rotation control unit for controlling the rotations of two different rotational driving means so as to synchronize the rotations of the two rotational driving means, as well as to perform soft start/stop control of the driving means.

One of the features of the spinning machine according to the present invention, resides in that it comprises at least a pair of feed rollers provided at a fiber working portion for carding the sliver or slivers and for feeding the sliver or the slivers to be carded and drafted, at least one first rotational driving means for driving the feed rollers, at least a pair of front rollers for drawing out and feeding the sliver or the slivers carded at the fiber working portion, at least one second rotational driving means for driving the front rollers, and an electronic rotation control unit for controlling the rotations of the two different rotational driving means so as to synchronize the rotation of the first rotational driving means with the rotation of the second rotational driving means at a predetermined rotational speed ratio.

One of the other features of the spinning machine according to the present invention resides in that it comprises at least a pair of feed rollers provided at the fiber working portion for carding at least a sliver and for feeding the sliver, at least one unevenness detector arranged upstream of the feeding direction of the sliver in the fiber working portion for detecting unevenness of the sliver, memory means for successively storing information about unevenness of the sliver detected by the unevenness detector, at least one first rotational driving source for driving the pair of feed rollers, at least a pair of front rollers for drawing out and feeding the sliver carded at the fiber working portion, at least one second rotational driving source for driving the pair of front rollers, and an electronic rotation control unit for controlling the rotations of the two rotational driving sources so as to synchronize the rotation of one said rotational driving source with the rotation of the other said rotational driving source by means of a predetermined rotational speed ratio, and so as to make uniform the thickness of the uneven part of the sliver drawn out from said front rollers, while feeding forward information about the sliver which has been stored in the memory means.

Yet still another feature of the spinning machine according to the present invention resides in the fact that the electronic rotation control unit can be realized by use of a microprocessor.

These objects mentioned above, other objects, features and advantages of the invention will be better understood from the following description of preferred embodiments according to the present invention with reference to the accompanying drawings.

DETAILED DESCRIPTION OF THE PREFERRED EMBODIMENT

Figure 1:
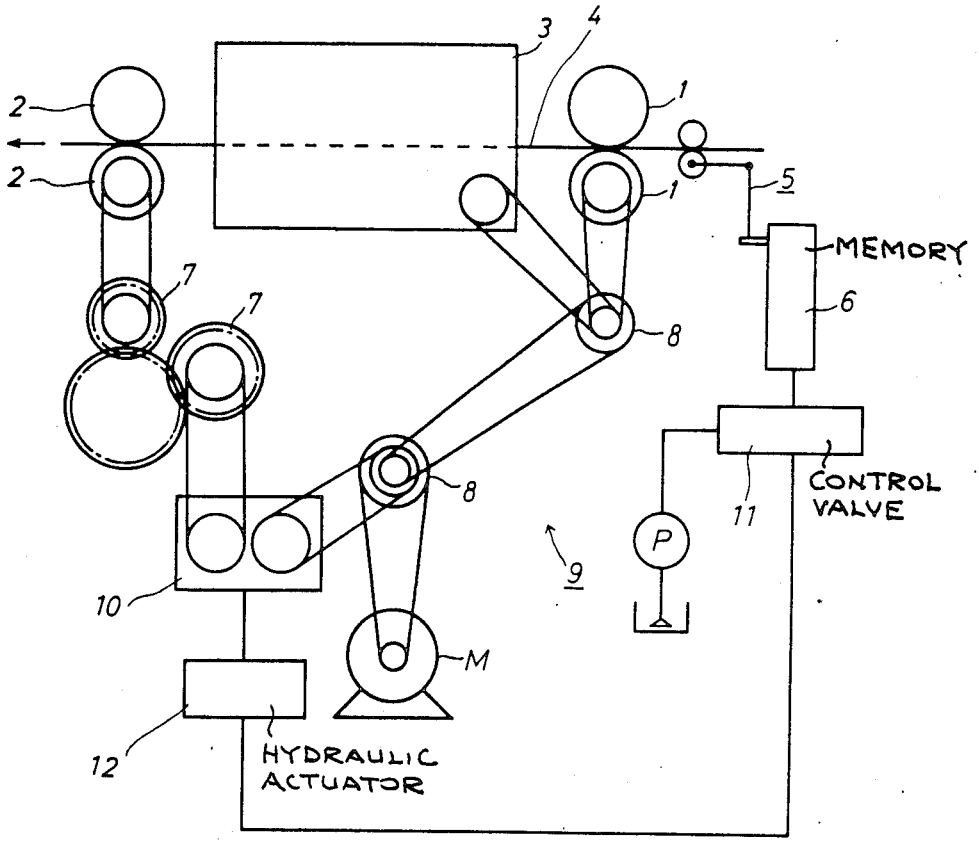
Fig. 1 PRIOR ART
FIG. 1 shows a general construction of the drawing frame according to the prior art.
Figure 2:
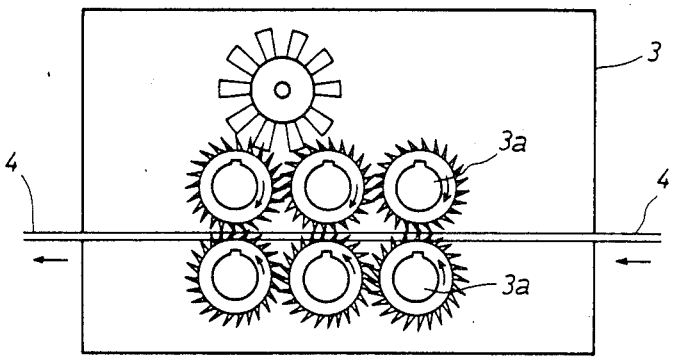
Fig. 2 PRIOR ART
FIG. 2 shows a construction of the gill box shown in FIG. 1 which consists of a plurality of rotational combs of one type according to the prior art.
Figure 3:
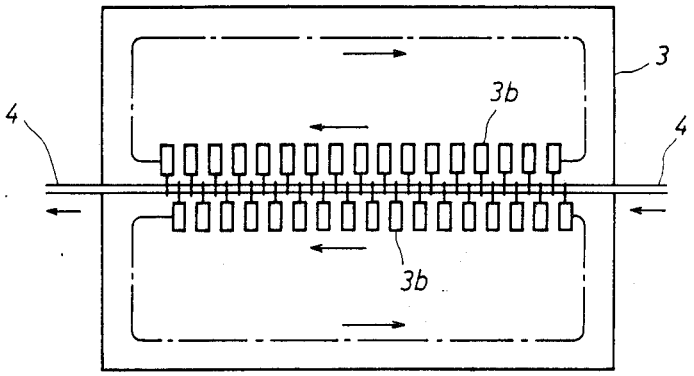
Fig. 3 PRIOR ART
FIG. 3 shows another construction of the gill box shown in FIG. 1 which consists of a plurality of combs of transversally moving type according to the prior art.
Figure 4:
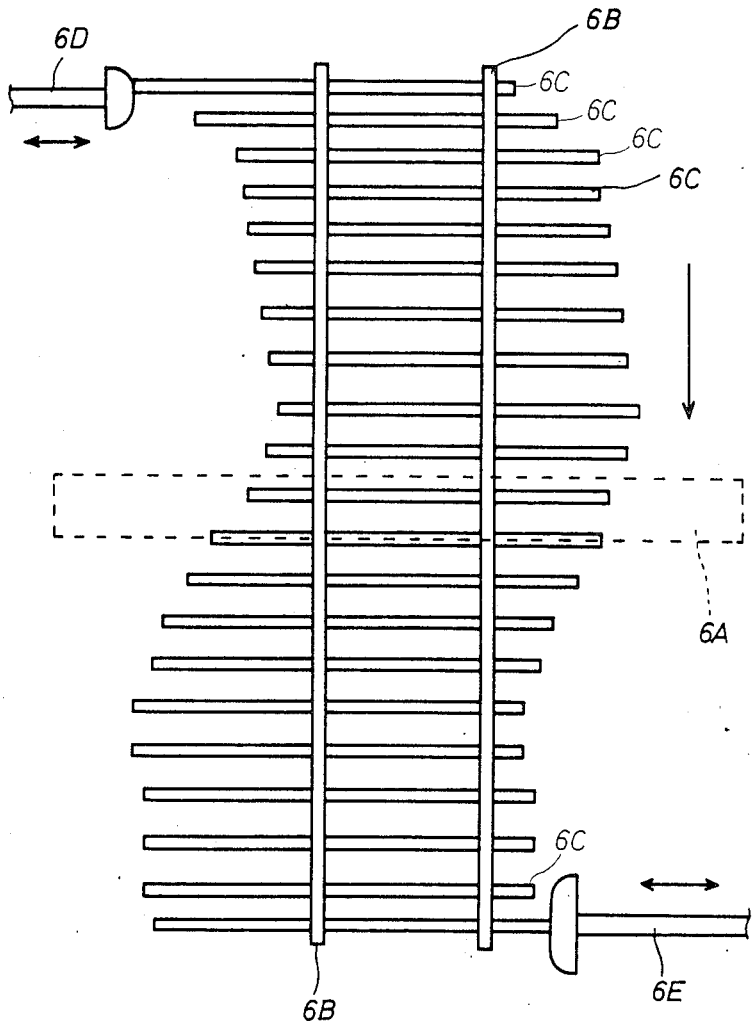
Fig. 4 PRIOR ART
FIG. 4 shows a construction of a mechanical memory for storing information about unevenness of a sliver, according to the prior art.
Figure 5:
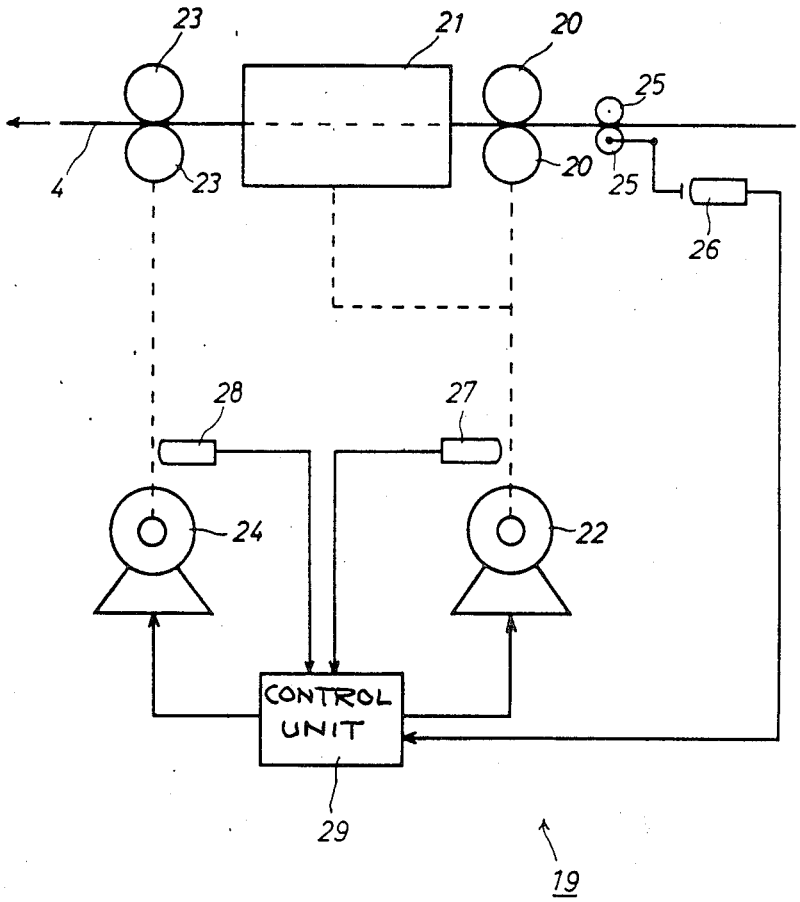
FIG. 5 shows general construction of a drawing frame of a first embodiment according to the present invention.

Referring to FIG. 5, where the drawing frame 19 according to the present invention is shown, which comprises:

a pair of feed rollers 20 which feeds a sliver 4 to a gill box 21 for carding;

a first motor 22 of AC variable speed type for driving the feed rollers 20 and combs in the gill box 21, which corresponds to a first rotational driving source and changes its rotational speed in accordance with the frequency of power supply (not shown);

a pair of front rollers 23 for drawing out the sliver 4 fed from the gill box 21 after carding and for feeding the sliver while drafting;

a second motor 24 of the AC variable speed type which corresponds to a second rotational driving source and drives the front rollers 23 and changes its rotational speed in accordance with the frequency of the power supply (not shown);

a pair of measuring rollers 25 one of which displaces the lower roller in accordance with the thickness of the sliver 4 a position sensor 26 for converting the displacement of the measuring rollers 25 into an electrical signal corresponding to an unevenness detector;

a first pulse generator 27 for detecting the rotational speed of the first motor and for generating first output pulses;

a second pulse generator 28 for detecting the rotational speed of the second motor and for generating second output pulses; and, a rotation control unit 29 for controlling the first motor 22 and the second motor 24.

Figure 6:
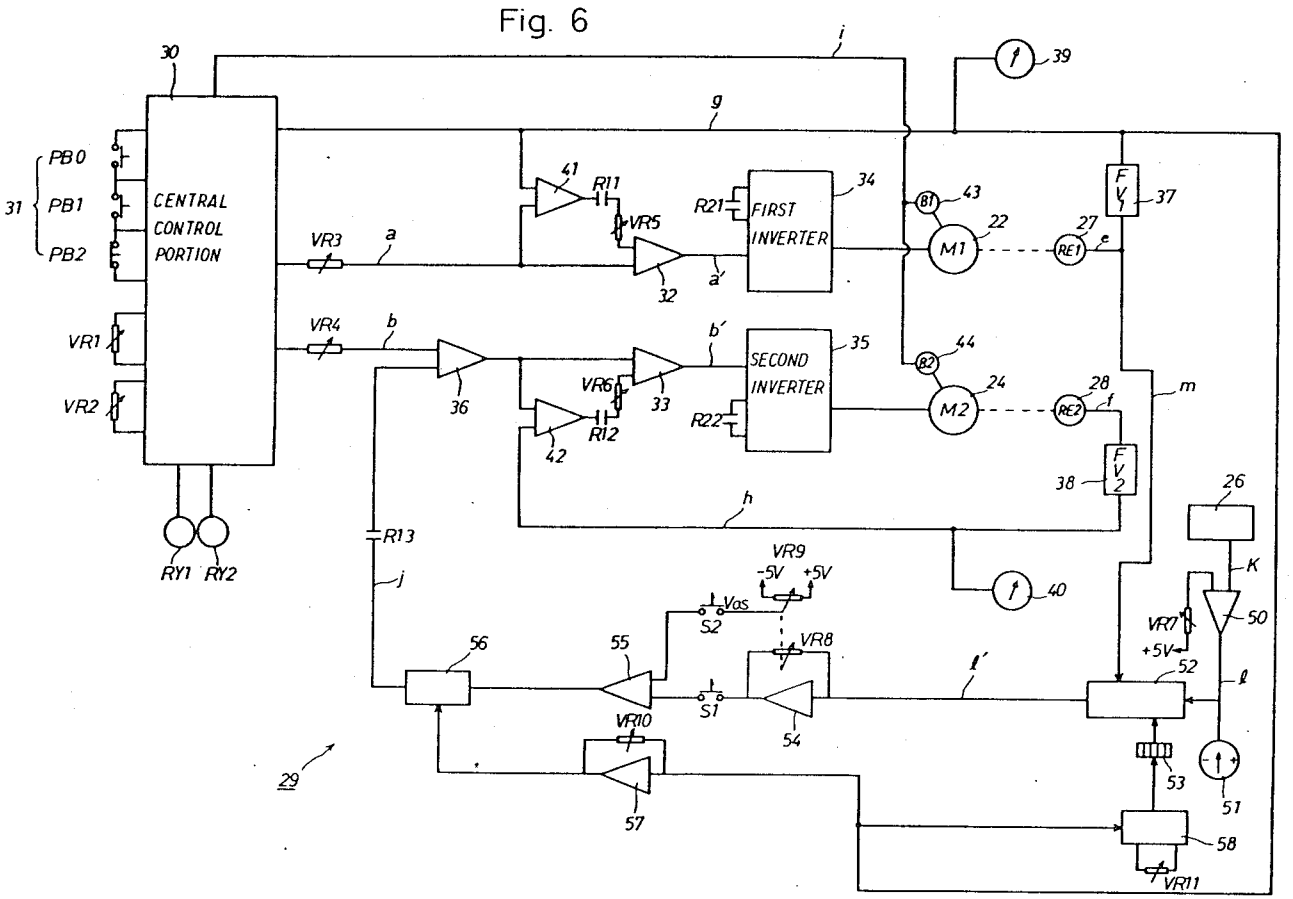
FIG. 6 shows a detailed circuit construction of an electronic rotation control unit according to the present invention.

FIG. 6 shows a detailed circuit diagram of the rotation control unit 29 which comprises a central control portion 30 having a first push button PB0, a second push button PB1 for starting, and a third push button PB2 for stopping. The central control portion 30 includes a power supply switch 31, a first variable resistor VR1 and a second variable resistor VR2 which set the timing for carrying out either operation, or release of electromagnetic brake means when performing either soft start or soft stop of the first motor 22 and the second motor 24, a third variable resistor VR3 for adjusting the carding speed (i.e. the feeding speed of the feed rollers 20) of the gill box 21 and a fourth variable resistor VR4 for adjusting the feeding speed of the front rollers 23.

Control signal a for controlling the first motor 22 is produced by the central control portion 30 through the variable resistor VR3 and applied to one input of a first adding circuit 32. Control signal b for controlling the second motor 24 is produced by the central control portion 30 through the variable resistor VR4 and applied to one input of a second adding circuit 33. After calculation of other signals, the control signal a is produced by the output of the adding circuit as a control signal a' and applied to a first inverter 34. After calculation of other signals, the control signal b is produced by the output of the adding circuit as a control signal b' and applied to a second inverter 35.

The first inverter 34 supplies a first AC power to the first motor 22, and the frequency of the AC power is changed in accordance with the voltage value of the control signal a. The second inverter 35 supplies a second AC power to the second motor 24, and the frequency of the AC power is changed in accordance with the voltage value of the control signal b. In this case, the control signal b from the variable resistor VR4 is processed in a unevenness-corrective operational circuit 36 before applying the second adding circuit 33.

The rotation of the motor 22 is controlled by the frequency of the AC power source supplied by the inverter 34 and the rotation of the motor 24 is controlled by the frequency of AC power source supplied by the inverter 35.

A pulse signal e produced by the first pluse generator 27 which is provided at a shaft of the motor 22 and synchronized with the rotation of the motor is converted into an analog signal g by the first frequency/voltage converter 38, while indicating the rotational speed of the motor 22 by a first rotation meter 39. A pulse signal f produced by the second pluse generator 28 which is provided at a shaft of the motor 24 and synchronized with the rotation of the motor is converted into an analog signal h by the second frequency/voltage converter 38, while indicating the rotational speed of the motor 24 by a second rotation meter 40.

The analog voltage signal g produced by the first frequency/voltage converter 37 is applied to the central control portion 30 and to a first comparing circuit 41, and the signal g is compared with the control signal a which is produced from the central control portion 30 in a comparing circuit 41. The result of the comparison, i.e. the output from the comparing circuit, is applied to the first adding circuit 32 through a normal open contact R11 of a first relay RY1 and a fine adjusting variable resistor VR5 of a semi-fixed type. Increase and decrease in the output frequency from the first inverter 34 is carried out by adding or subtracting the voltage of the control signal a with the output from the comparing circuit 41, in such a manner that the number of rotations of the first motor 22 coincides with the number of set rotations.

On the other hand, in order to control the rotation of the second motor 24, the analog voltage signal h is compared in a second comparing circuit 42 with the control signal b which is produced by the central control portion 30 through the variable resistor VR4 and the unevenness-corrective-operational circuit 36, and the result of the comparison from the comparing circuit 42 is applied to the second adding circuit 33 through a normal open contact R12 of the first relay Ry1 and a fine adjusting variable resistor VR6 of the semi-fixed type, such that by regulating the voltage of the control signal b, the increase or decrease in the output frequency from the second inverter 35 is carried out so as to coincide the number of rotations of the second motor 24 with the number of set rotations.

Figure 7:
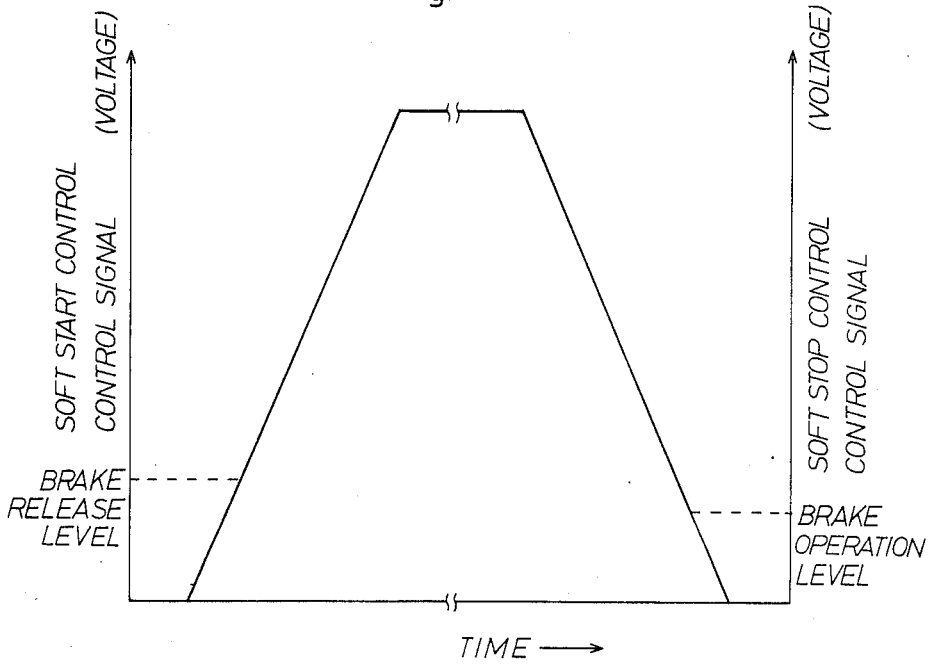
FIG. 7 shows a program characteristic curve of a control signal to be applied to brake means, showing a brake operational level and a brake release level.

As shown in FIG. 7, a brake signal i for starting the first motor 22 and the second motor 24 at the same time is output from the central control portion 30 to a first electromagnetic brake 43 and a second electromagnetic brake 44 when the control signal reaches a predetermined voltage level (brake release level) set by the variable resistor VR1, and the brake signal i for stopping is output from the central control portion 30 to a first electromagnetic brake 43 and a second electromagnetic brake 44, when the control signal reaches another predetermined voltage level (brake operation level)set by the variable resistor VR2.

Normally, as different loads are applied to the first motor 22 and the second motor 24, each inverter 34, 35 controls its output frequency respectively, somewhat in the frequency range of 0 to a few Hz just before or after the motors start or stop, where it is rather difficult to control the number of rotations completely. During that period, however, the feed rollers 20, the gill box 21 and the front rollers 23 are maintained in the stop condition by operating the first and the second elelctromagnetic brake means 43 and 44 simultaneously, so as to prevent the sliver 4 from being cut or wound in the gill box 21.

The first inverter 34 and the second inverter 35 are set by turning ON the push button PB1 for starting, and ON-Off control of the output thereof is carried out by the normal open contacts R21, R22 of the second relay RY 2 which is set when the control signal a or the control signal b reaches a predetermined level due to the depression of the push button PB2 for stopping, i.e. ON condition of the button PB2.

A feed-forward control signal j for adjusting the unevenness is applied to one terminal of the unevenness-corrective operational circuit 36 through the normal open contact R13 of the first relay RY1 for braking. The feed forward controll signal j enables the the uneven parts of the sliver 4 to be detected by the displacement of the measuring rollers 25, so that unevenness of the sliver is converted into an electrical signal K by the position sensor 26. The electrical signal K is compared in a comparing circuit 50 with a reference voltage which is adjusted by a variable resistor VR7 and the output voltage corresponding to either excess or shortage to the reference voltage is produced by the comparing circuit 50 as an unevenness detection signal l.

The output is displayed on a spot display meter 51 for displaying either the excess or shortage of thickness of the sliver, while the unevenness detection signal 1 is stored in a semiconductor analog memory 52 as a memory unit. The analog memory 52 has maximum of 2500 addresses in the embodiment according to the present invention, and the voltage of the unevenness detection signal 1 is stored successively in each address by a pulse signal m produced by a first pulse generator 27. The unevenness detection signal 1 thus temporarily stored in the analog memory 52 is again read out of the address set by a digital set switch 53, that is, the address into which the signal l is stored with previous pulses by the number of pulses Q of the pulse signal m and then applied to an offset voltage adding circuit 55 having two inputs through an amplifier 54 and a manually operated switch S1, as an unevenness reproduction signal 1'. The amplification factor of the amplifier 54 is modified by a variable resistor VR8 in accordance with the draft rate. The offset voltage Vos set by the variable resistor VR9 which is interlocked with VR8 is applied to the other input of the offset voltage adding circuit 55 through the manually operated switch S2 in accordance with the draft rate, and then offset voltage is applied to an electronic attenuator 56 including transistors which produces an attenuated output for the input signal applied thereto in response to a control signal.

The unevenness reproduction signal 1' produced by the analog memory 52 is applied first to the amplifier 54 then to the circuit 55 where the voltage of signal 1' is adjusted in accordance with the draft rate, is again adjusted in the attenuator 56 in accordance with the analog voltage signal g produced by the first frequency/voltage converting circuit 37 and it is output therefrom as the feed-forward control signal j.

The unevenness of the sliver 4 is detected by a position sensor 26 as a voltage signal, having the same amplitude as shown in FIG. 7, regardless the conditions of control, i.e., during the soft starting control, soft stopping control, or steady high speed operating condition.

As excessive control occurs if the control is carried out in accordance with the unevenness reproduction signal 1' during the soft starting control or the soft stopping control, therefore, the analog voltage signal g is adjusted by the variable resistor VR10 of an amplifier 57, in such a manner that 100% of the signal produced by the offset voltage adding circuit 55 can be passed through the electronic attenuator 56, when the analog voltage signal g reached the maximum voltage thereof, and the produced signal is conventionally attenuated in accordance with the value of the analog voltage signal g, thus forming the feed-forward control signal j.

The feed-forward control signal j enables the position detector 36 to detect the uneven parts of the sliver, and when the uneven parts of the sliver are discharged from the end of the gill box 21, the rotational speed of the front rollers 23 is controlled so as to correct the unevenness. However, since a response lag time particular to the control system which is not affected by the carding speed in the control system of the drawing frame exists, a delay in control occurs in accordance with an increase in rotational speed of the first motor 22, in the method for retrieving the unevenness detection signal l temporarily stored in the address, the number of which is larger than the pulse signal m by the number of pulses Q, set by the digital switch 53, corresponding only to the distance from the measuring rollers 25 and to the front rollers. Accordingly, it is necessary to reduce the number of pulses Q in accordance with the value of the analog voltage signal g. The electronic attenuator 58 for adjusting the delay similar to that of the attenuator 56 functions to decrease the number of pulses Q in such that the number of pulses Q which is set to the digital set switch 53 is decreased by a predetermined amount in accordance with the analog voltage signal g.

A variable resistor VR11 is for the fine adjustment for the delay.

The operation of the embodiment of the circuit thus constructed is described below.

In this embodiment, supposing that the change speed ratio between the feed rollers 20 and the gill box 21 due to the rotation of the motor 22 is made equal to the change speed ratio of the front rollers 23 due to the rotation of the motor 24, and the draft rate is equal to 4. Namely, this is a case where the front rollers 23 are rotated at the feeding speed of four times faster than that of the front rollers 20 and the gill box 21.

The control signal a which is applied to the first adding circuit 32 from the central control portion 30 is similarly added to the difference voltage which is produced through the variable resistor VR11 and VR5 in accordance with the result of the comparison of the control signal a applied to the first comparing circuit 41 and the analog voltage signal g, and the control signal a is applied to first inverter 34 as the control signal a'.

Figure 8:
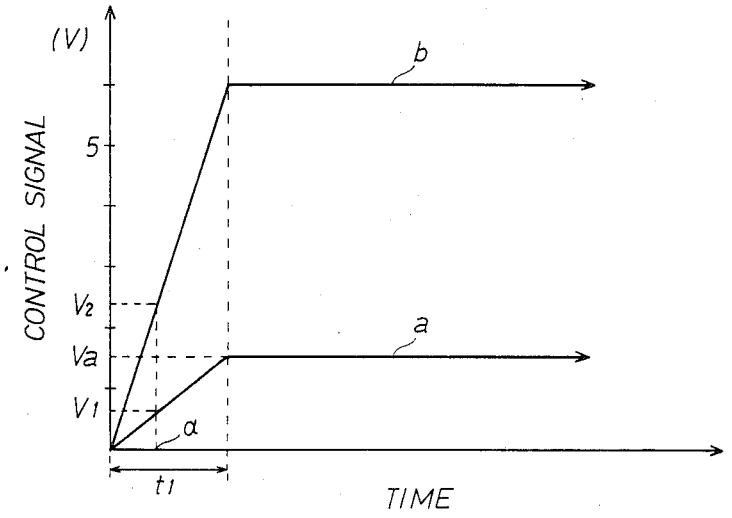
FIG. 8 shows a characteristic curve of a control signal a, and a control signal b in voltage to be adjusted in one embodiment according to the present invention.

As shown in FIG. 8, the control signal a is increased gradually to a predetermined level Va (in the present embodiment, Va is 1.5 V) by the central control portion 30 through VR3 during the time period t1 after starting. The control signal b which is four times higher than the control signal a in voltage is also produced by the central control portion 30 after the adjustment of the variable resistor VR4. For instance, the voltage $V_2$ of the control signal b is four times higher than the voltage $V_1$ of the control signal a at the time $\alpha$, and the voltage $V_2$ of the control signal b is applied to the second adding circuit 33 and the second comparing circuit 42 through the unevenness corrective-operational circuit 36 similar to the case of the control signal a.

When stopping the drawing frame 19, the control signal a and the control signal b gradually decreased to 0 during a predetermined time period, contrary to the time of starting. The correction, that is addition, is carried out in the second adding circuit 33 in accordance with the result of the comparison in the second comparing circuit 42.

Figure 9:
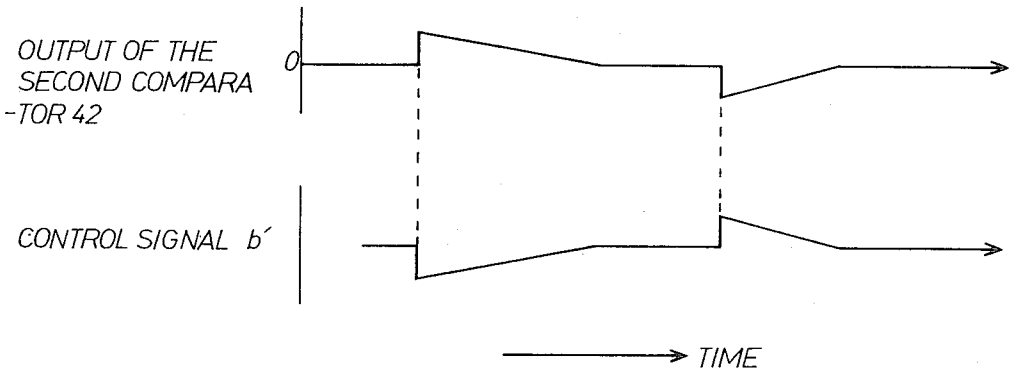
FIG. 9 shows a relationship between the output from the second comparator and the control signal b′ in FIG. 6, FIG. 10(*a*) shows the relationship between the thickness of a sliver and the length of the sliver after correction according to the prior art, and the FIG. 10(*b*) shows the relationship between the thickness of a sliver and the length of the sliver after correction according to the present invention.

The correction is made in such a manner that the signal h which is converted into analog voltage signal by the second frequency/voltage converting circuit 38 to represent the rotational speed of the second motor 24 is compared with the controlling signal b adjusted in voltage in accordance with the draft rate and produced by the central control portion 30, in the second comparing circuit 42, and the difference thereof is applied to the second adding circuit 33 through the contact R12 and the variable resistor VR6, and is added to the control signal b in the second adding circuit 33 and then is produced as a signal b' therefrom. The control signal thus produced is applied to the second inverter 35. As a result, the output frequency of the second inverter 35 is changed and this changes the rotational speed of the second motor 24 in turn, as a result the value of the analog voltage signal h is made equal to the voltage produced from the unevenness-corrective operational circuit 36. Accordingly, as shown in FIG. 9, the change in the output of the comparing circuit 42 is fed back to the control signal b by the second adding circuit 33, the thus produced control signal is applied to the second inverter 35. The output from the inverter 35 controls the rotational speed of the second motor 24 so as to obtain a desired draft rate.

When the uneven parts on the sliver 4 are detected by the position sensor 26 during carding and drafting of the sliver 4 by the drawing frame 19, an output electrical signal K corresponding to the uneven parts detected by the position sensor 26 is applied to the comparing circuit 50 which compares the output electrical signal K with a reference voltage corresponding to a reference or standard thickness, and the difference is stored in the analog memory 52. When the same number of pulses m as the number of set pulses Q' after a suitable delay time adjustment in accordance with the analog voltage signal g are input, the unevenness reproduction signal l' is produced as the feed-forward control signal j through the amplifier 54, the offset voltage adding circuit 55, and the electronic attenuator 56 by the adjustment thereof.

The signal j is further applied to the unevenness-corrective operational circuit 36 through the contact R13, and the output from the unevenness-corrective operational circuit 36 controls the rotation of the second motor 24 by the output adjustment of the second inverter 35 so as to correct the unevenness of the slivers. As a result, when the thick unevenness of the sliver 4 is detected by the position sensor 26, the rotational speed of the front rollers 23 is increased at the time when the sliver having the uneven part is discharged from the gill box 21 to make the draft rate to be temporarily large, so that the thickness of the sliver 4 discharged from the drawing frame 19 is made uniform.

On the other hand, when the thin unevenness of the sliver 4 is detected by the position sensor 26, the rotational speed of the front rollers 23 is decreased at the time when the sliver is discharged from the gill box 21, and this makes the draft rate to be temporarily small to make uniform the thickness of the sliver 4 discharged from the drawing frame 19. As shown in FIG. 7, during the soft start control or the soft stop control, the output signal from the offset voltage adding circuit 55 is controlled in accordance with the analog voltage signal g, which is applied to the attenuator 56 through the amplifier 57, and an ultimate feed-forward control signal j is produced.

As described in the foregoing embodiment according to the present invention, the drawing frame 19 has different driving sources; one is for driving the feed rollers 20 and the gill box 21, and the other is for driving the front rollers 23. The two driving sources are synchronized so as to maintain a constant rotational speed ratio while controlling the rotation of the front rollers so as to level off the uneven parts of the sliver 4. The uneven parts of the sliver 4 are detected by the measuring rollers 25 and the position sensors, and levelled off by changing the rotational speed of the front rollers 23, after the uneven part of the sliver 4 is discharged from the gill box 21 to when it reaches to the front rollers.

With this construction according to the present invention, when a plurality of slivers put together are carded and drafted into one sliver 4 having a desired thickness, the adjustment of the draft rate can be simply carried out by the mere adjustment of the attenuator VR 3 and the variable resistor VR4 without changing the gears.

Figure 10:
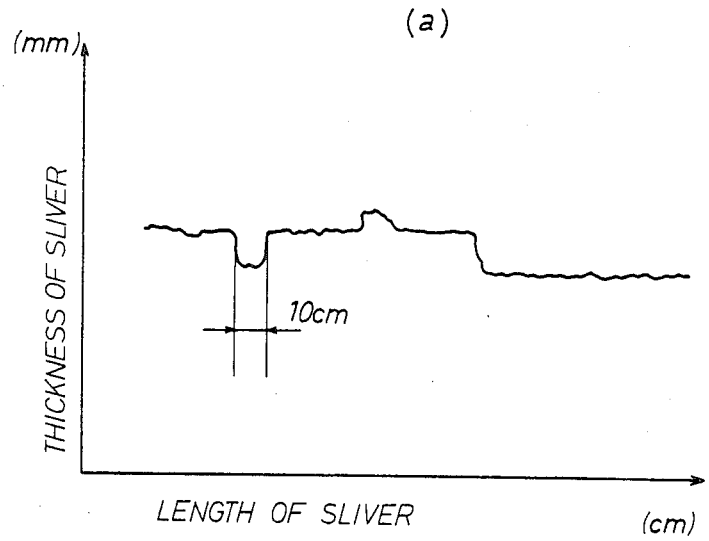
Figure 10:
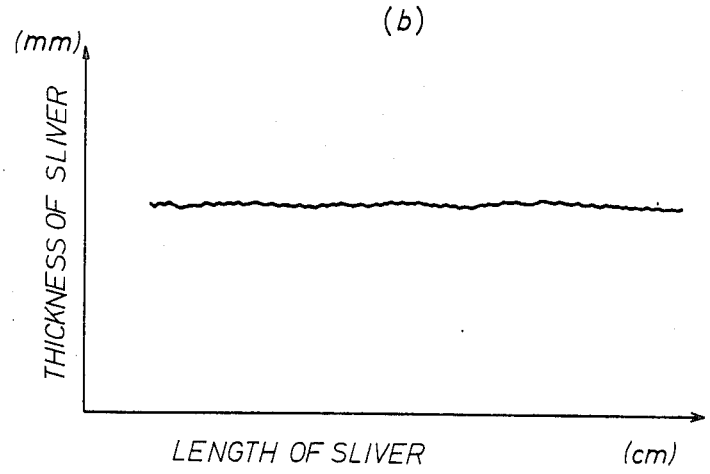

Moreover, according to the present invention, a relatively short uneven part of the sliver as shown in FIG. 10(*a*) which was considered to be difficult to be levelled off in the prior art, can be levelled off to have uniform thickness as shown in FIG. 10 (*b*).

Figure 11:
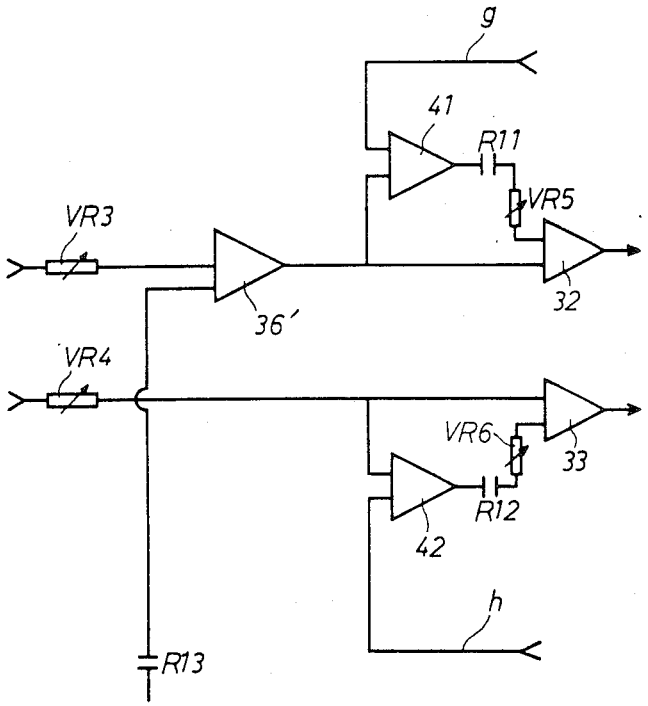
FIG. 11 shows variation of a part of the circuit in FIG. 6 for controlling the rotation of the feed rollers.

In addition to the foregoing embodiment according to the present invention, the rotation of the front rollers 23 is controlled so as to level off the slivers, it is also possible that the rotational speed of both feed rollers 20 and the gill box 21 may be controlled so as to level off the sliver by directly applying the control signal b to the second adding circuit 33 as shown in FIG. 11, and by applying the control signal a to the first adding circuit 32 through the unevenness-corrective operational circuit 36' as well as by inverting, in the invertor circuit 60, the polarity of the feed-forward control signal j which is applied thereto through the contact R13 into the feed-forward control signal j' and applying it to the unevenness-corrective operational circuit 36'.

Figure 12:
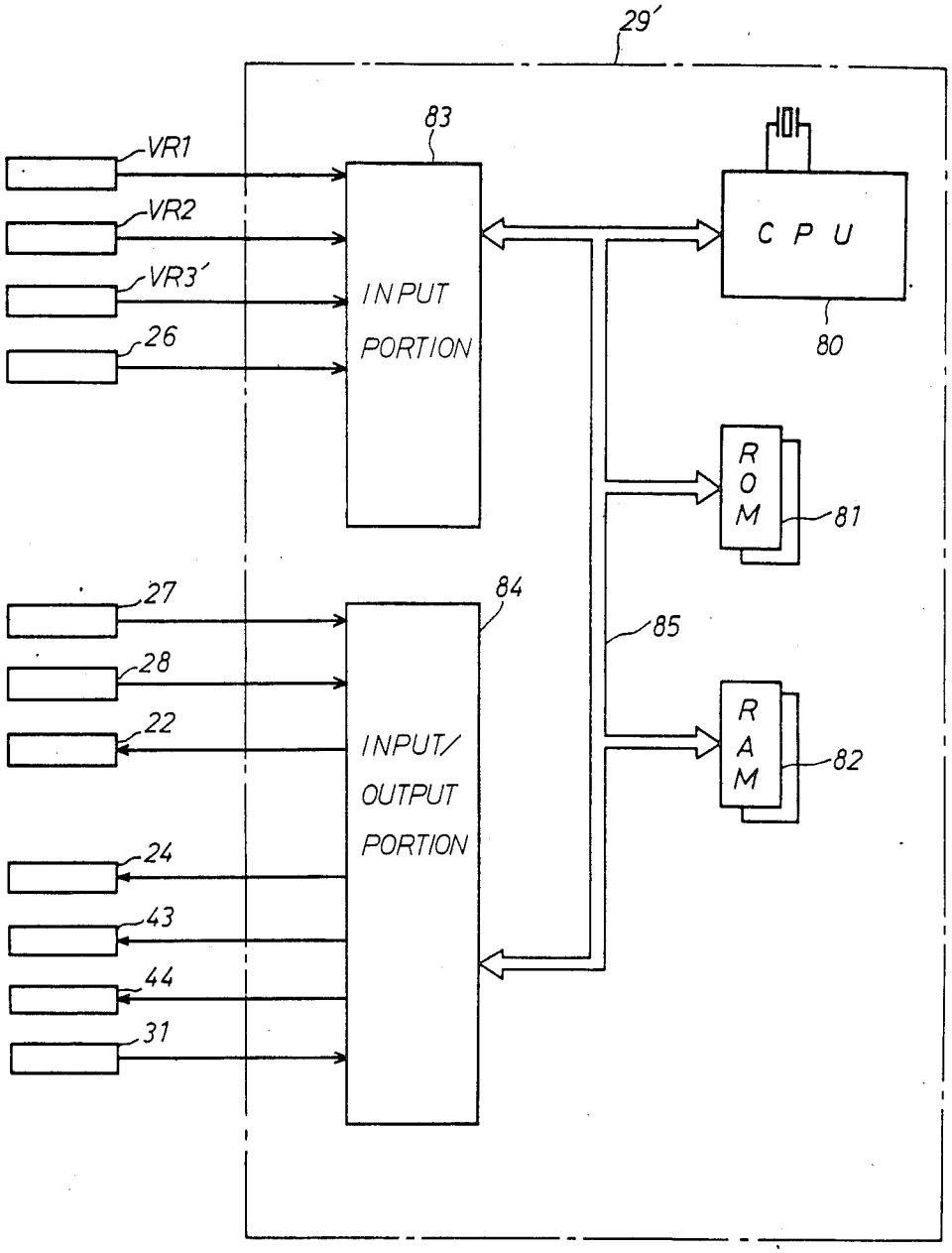
FIG. 12 shows a second embodiment of the rotation control unit realized by use of a microprocessor, according to the present invention.
Figure 13:
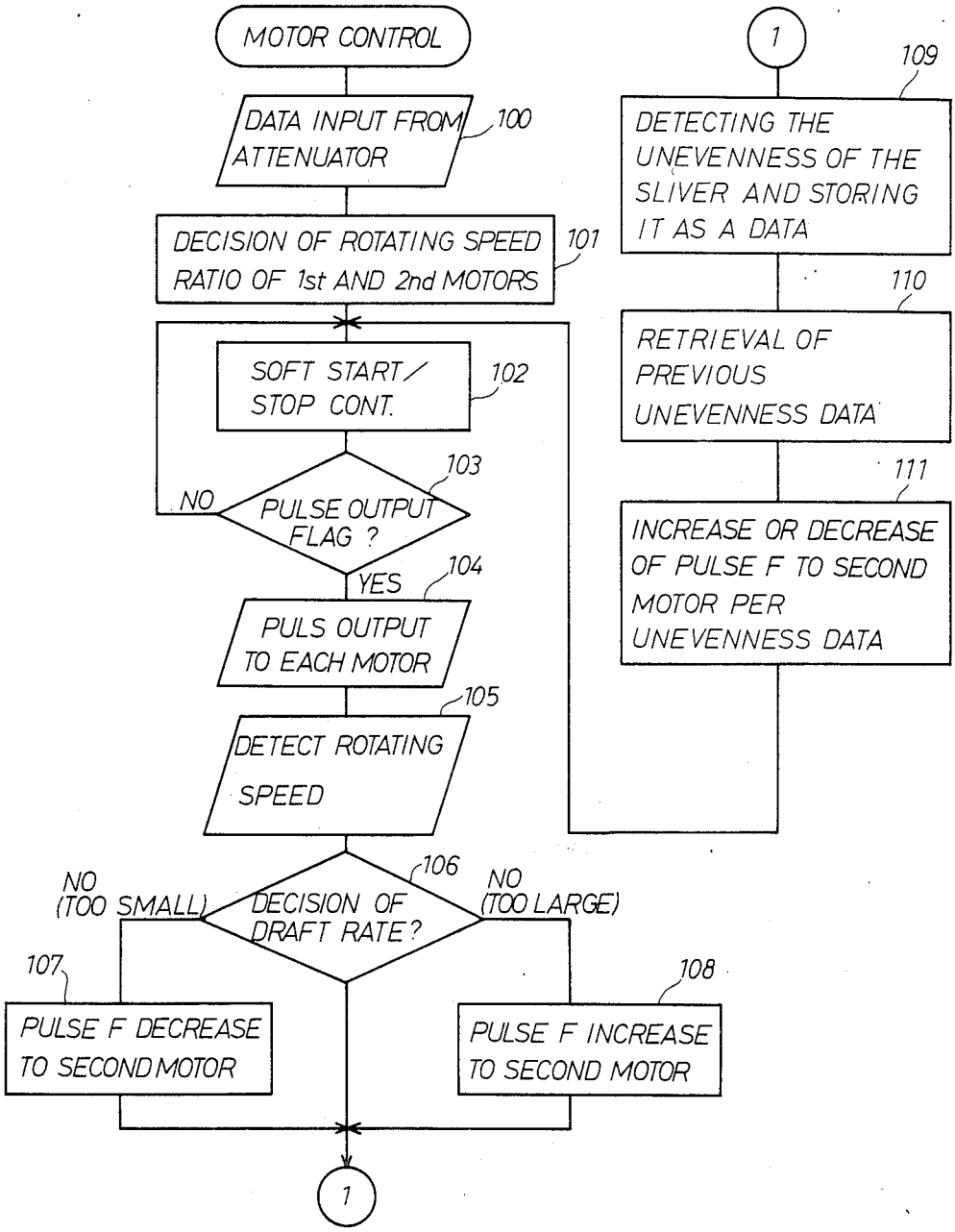
FIG. 13 shows a program flow chart for a motor control by the use of the microprocessor in FIG. 12.
Figure 14:
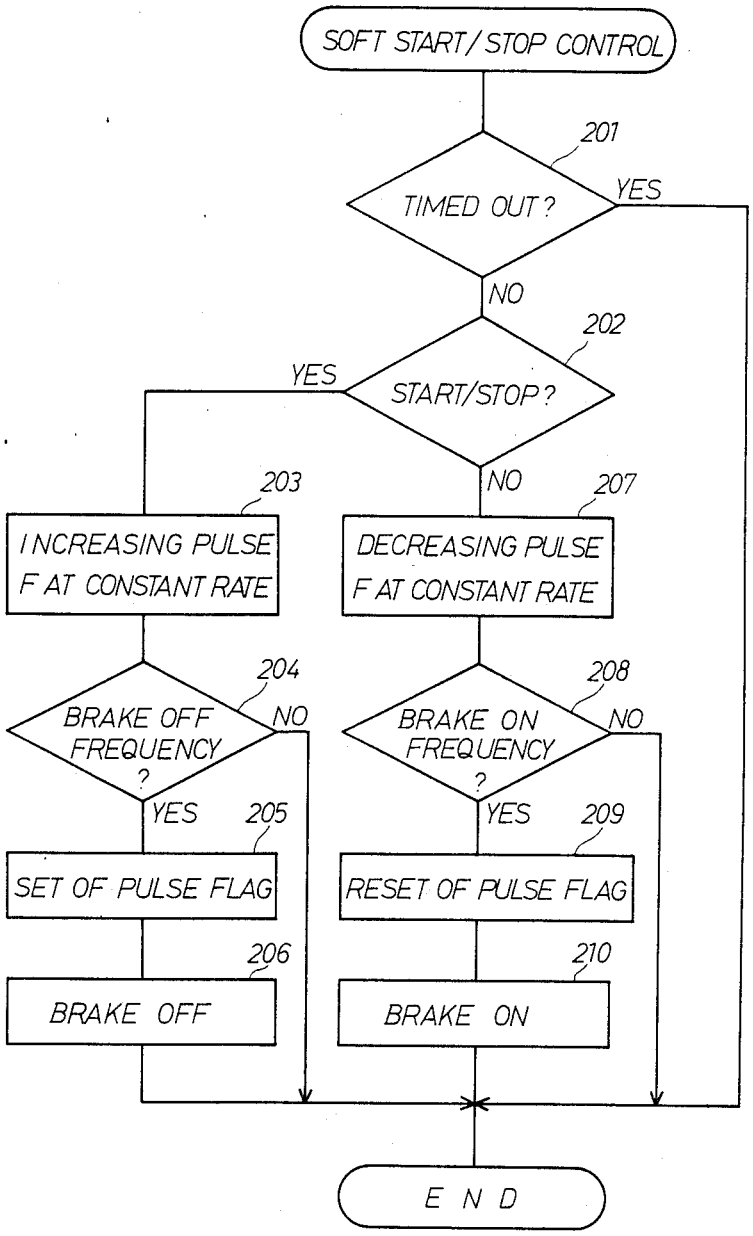
FIG. 14 shows a program flow chart for the soft start/stop control by the use of the microprocessor in FIG. 12.

A second embodiment according to the present invention is described below. FIGS. 12 to 14 show this embodiment in which the rotation control circuit is realized by use of a microprocessor 29'.

The microprocessor 29' comprises a central processing unit (CPU) 80 for receiving various signals and data from external elements and units, and for processing them, a read only memory (ROM) 81 for storing control programs and necessary data, a random access memory (RAM) 82 for storing various data including data to be applied to the rotational control unit 29, in FIG. 6, an input portion 83 including an input port, a multiplexer for selectively inputting signals from each variable resistor, and an analog/digital converter (A/D converter) for converting analog signals produced by the multiplexer into digital signals, not shown, and an input output portion 84 including waveform shaping circuits for signals to be input thereto and each driving circuit for driving the first motor 22 and the second motor 24, and the first electromagnetic brake means 43 and the second electromagnetic brake means 44, although the circuits are not shown.

The output of the variable resistor, VR1, VR2, VR3' and the position sensor 26 are connected to each input of the input portion 83, respectively.

The output of the first pulse generator 27 for detecting each rotational speed of the first motor 22, and the output of the first pulse generator 28 for detecting each rotational speed of the second motor 24 for producing detected pulses are connected to each input of the input and output portion 84, while the output of the power supply switch 31 is also connected to the input of the input and output portion 84, respectively.

On the other hand, each output of the input and output portion 84 is connected to each input of the first motor 22 and the second motor 24, and to each input of the first electromagnetic brake means 43 and the second electromagnetic means 44, respectively through each driving circuit not shown nor mentioned above. A bus 85 communicates among the CPU 80, ROM 81, RAM 82, the input portion 83, and the input and output portion (I/O) 84.

The CPU 80 operates various signals and set data provided from the first pulse generator 27 and the second pulse generator 28, the power supply switch (a push button switch) 31, the variable resistors VR1, VR2, VR3' etc. in accordance with the control programs stored in the ROM 81, and the CPU 80 controls the first motor 22 and the second motor 24, and the first electromagnetic brake means 43 and the second electromagnetic brake means 44.

FIG. 13 shows a control program flow chart for the motor control, and FIG. 14 shows another control program flow chart for the soft start/stop control.

The operation of the microprocessor 29', to which various elements and units are connected as shown in FIG. 12 is described with reference to the control program flow charts of FIG. 13 and 14.

Referring to FIG. 13, the power supply switch 31 of the drawing frame is turned ON, and the draft rate which is set by the VR3' as well as the voltage levels of the soft start and soft stop control which is set by the variable resistor VR1 and the variable resistor VR2 are input to the microprocessor 29' in the step 100, and then the operation moves to the next step 101.

In the step 101, the frequency ratio of the pulse signals to be applied to the first motor 22 and the second motor 24, i.e. the rotational speed ratio is determined in accordance with the draft rate set by the variable resistor VR3'. At the same time, the first electromagnetic brake means 43 and the second electromagnetic brake means 44 are energized respectively, and the operation moves to the next step 102. In this step 102, the soft start/stop control operation is carried out, and the operation then moves to the next step 103.

In the step 103, a decision or determination is made whether or not a pulse output flag is set to "1". If the result of the decision is NO, that is, the flag is not set, the output of the pulse signal to the motors 22 and 24 are stopped, and then the operation returns to the step 102. The above mentioned operation in step 103 is repeated until the pulse output flag is set to "1" in the soft start/-stop control routine. On the other hand, however, if the result of the decision if YES, i.e. the flag has been set, the operation moves to the next step 104.

In the step 104, the pulse signals, the frequencies of which have already been determined, are applied to the first motor 22 and the second motor 23, and the operation moves to the next step 105. In this step 105, the rotational speed of each motor is detected respectively by the first pulse generator 27 and the second pulse generator 28, and output pulse is produced therefrom respectively, which is proportional to the rotational speed of each motor 22 and 24, and the operation moves to the next step.

In the step 106, the decision of the draft rate is performed in accordance with the rotational speed of each motor. In this case, if the result of the decision is YES, i.e. the actual draft rate coincides with the draft rate set by the variable resistor VR3', the operation moves to the next step 109, and afterwards the present routine operations are repeatedly executed. However, the result of the decision in the step 106 is NO, i.e., the actual draft rate is smaller than the draft rate set by the variable resistor VR3' (the actual draft rate is short in this case), the operation which has been performed in the step 107 is executed in order to increase the actual draft rate in such a manner that the frequency of the pulse signal to be applied to the second motor 24 is decreased to a certain amount, and then the operation moves to the next step 109.

On the other hand, if the result of the decision is NO and the actual draft rate is larger than the draft rate set by the variable resistor VR3' (the actual draft rate is excessive in this case), the same operation as performed in the step 108 is carried out in order to lower or decrease the actual draft rate, in such that the frequency of the pulse signal to be applied to the second motor 24 is increased to a predetermined amount, and then the operation moves to the next step 109.

In the step 109, the unevenness of the sliver 4 is detected by both the measuring rollers 25 and by the position sensor 26, the analog data thus detected is converted into digital data by the an A/D converter, not shown, and then stored in a certain area in the RAM 82. Then the operation moves to the next step 110, where the previous data about the unevenness of the sliver which have been detected and stored in the RAM 82 in accordance with both the distance between the measuring rollers 25 and the end of the gill box 21 and the rotational speed of the first motor 22, are retrieved therefrom. After this, the operation moves to the next step 111.

In the step 111, the frequency of the current pulse is either increased or decreased in accordance with a retrieved data about unevenness and the draft rate, and then the operation moves to the next step 102.

In this manner as described above various operations are performed and the sliver 4 can be levelled off, while suitable carding and drafting of the sliver can be carried out so as to make a desired draft rate.

The followings are descriptions about the program flow chart for performing the soft start/stop operations as shown in FIG. 14.

When this routine is performed, there comes a first decision 201, at first. In the step 201, it is made a decision of the elapsed time after entering either the soft start control or the soft stop control. Namely, the decision is made corresponding to whether or not a predetermined time has been elapsed, that is time-out after entering the control. If the result of the decision is YES, that is, time-out, the operation of this routine terminates, as it is no longer necessary performing either the soft start control or the soft stop control.

On the other hand, if the result of the decision in the step 201 is NO, i.e. it is not time-out, the operation moves to the step 202. In this step 202, a second decision whether the current operation is the operation for soft start or the operation for soft stop based on the status of the power supply switch 31 is determined. If the result of the decision is YES, i.e. the operation is in the soft start control, the operation moves to the next step 203.

In the step 203, the frequencies of the pulse signals which have been already determined and are applied to the first motor 22 and the second motor 24 are increased by certain rate respectively, for instance, 5 percent (%), and the operation moves to the next step 204. In the step 204, there is made a third decision whether or not the frequency of the pulse signal which is applied to, for instance, the first motor 22 becomes equal to that of a signal for the brake releasing, which signal is set by the variable resistor VR1.

If the result of the decision is NO, the operation of this routine terminates. However, if the result of the decision is YES, that is, it is equal to the brake releasing frequency, the step moves to the step 205 where the pulse output flag is set to "1". Then, the operation moves to the next step 206. In the step 206, the first electromagnetic brake means 43 and the second electromagnetic brake means 44 are released, and the operation of this routine terminates.

On the other hand, in the step 202, if the result of the decision is that of requiring the soft stop, the operation moves to the step 207 where the frequencies of the pulse signals which have been already determined and applied to the first motor 22 and the second motor 24 are decreased at a predetermined rate, for instance, by 5% and the next operation is executed. Namely, in the step 208, the decision is made if the frequency of the pulse signal to be applied to the first motor 22, for instance, becomes equal to the brake releasing frequency set by the variable resistor VR1 or not. If the result of the decision is NO, the operation of this routine terminates. However, if the result of the decision is Yes, that is it is equal to the brake releasing frequency, then the operation moves to the next step 209.

In the step 209, the pulse output flag is reset, i.e. set to "0" state, and then the operation moves to the next step 210, where the first electromagnetic brake means 43 and the second electromagnetic brake means 44 are energized, and the operation terminates.

As described in the foregoing embodiment according to the present invention, the soft start/stop control for the first motor 22 and the second motor 24 can be carried out in accordance with the program flow chart as shown in FIG. 14. In the second embodiment according to the present invention as described in the foregoing, the same control as performed by the rotation control circuit as shown in FIG. 6 can be realized by the microprocessor construction.

Figure 15:
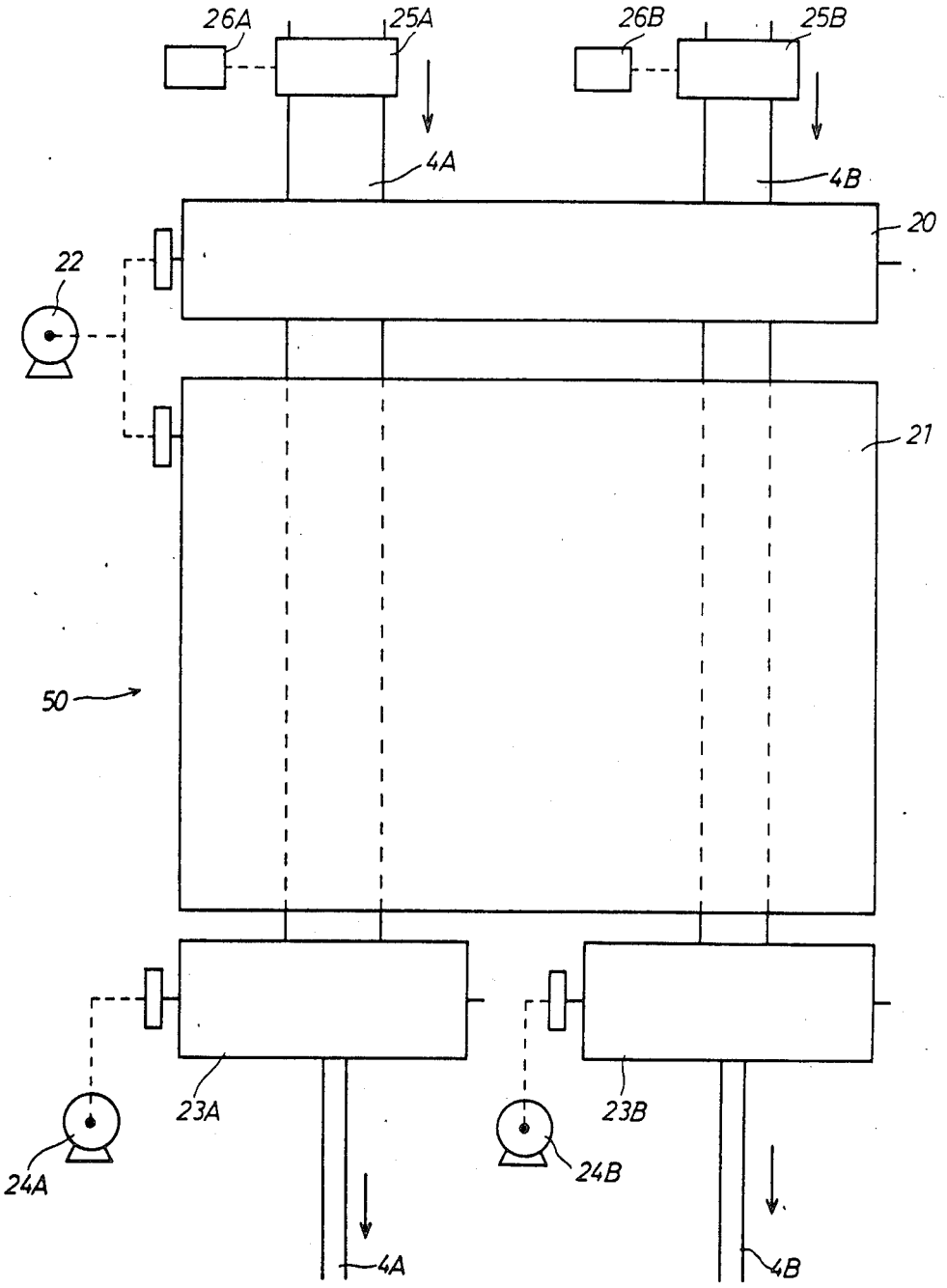
FIG. 15 is a third embodiment of the drawing frame according to the present invention.

Next, the third embodiment of the drawing frame according to the present invention is illustrated in FIG. 15. The drawing frame of this embodiment comprises a pair of the feed rollers 20, the gill box 21, the first motor 22, two pairs of the front rollers 23A and 23B instead of the pair of the front rollers 23A in the first embodiment, two pairs of measuring rollers 25A and 25B instead of the pair of measuring rollers 25, two position sensors 26A and 26B instead of the one position sensor 26, and the second motors 24A and 24B for driving each pair of front rollers 23A and 23B, thereby enabling the carding and drafting of two slivers 4A and 4B by the one drawing frame 50 with different draft rates, respectively. In this third embodiment, two rotation control units which can be realized by either the rotation control circuit as shown in FIG. 6, or the microprocessor construction 29' as shown in FIG. 12 are provided, although not shown in FIG. 15.

In addition, in the third embodiment according to the present invention, the provision of plural rotation control circuits, plural unevenness-detecting portions, plural pairs of front rollers, and plural second motors as the case may be, enables different slivers at different draft rates, respectively to be carded and drafted at the same time by one drawing frame. Moreover, in the third embodiment according to the present invention, the drafting can be carried out between the gill box 21 and the feed rollers 22 by the provision of a pair of the front rollers 23, plural pairs of the feed rollers 22 and plural gill box 21.

In the embodiment according to the present invention, as described in the foregoing, carding and drafting of the slivers can be carried out by one drawing frame at different draft rates, respectively. Moreover, according to the present invention, a space for the installation of the drawing frame can be reduced to one machine-space, therefore it is possible to realize a drawing frame with a high efficiency in view of economy.

In the foregoing embodiments according to the present invention, the description has been made, particularly, in case of the drawing frame. However, it is apparent for those skilled in the art that the construction of each embodiment can also be applied to spinning machine in the subsequent spinning process.

As described in the foregoing, the spinning machine according to the present invention is constructed in such a manner that the feed rollers and the front rollers are driven separately or independently, by different motors for controlling its rotational speed respectively, while detecting unevenness of the sliver and storing the information about the sliver to be carded and drafted in the upper stream of a fiber working portion into a memory and the rotational speed ratio between the feed rollers and the front rollers is changed accurately in accordance with the information about the unevenness thus stored in the memory, so that change of the draft rate can be promptly carried out without changing gears, different from the prior art, and a wide range of slivers including slivers having short or long uneven parts and unusually thin or thick slivers are adjusted and levelled off continuously, therefore slivers of good quality can be produced.

Moreover, according to the present invention, since the speed change ratio of the gears is not fixed, the setting of the draft rate can be arbitrary and yet than machines according to the prior art wherein an expensive stepless gear with a complicated construction is provided while the operation noise can be made smaller and the weight of the unit can be reduced.

Furthermore, the provision of pairs of feed rollers and pairs of front rollers to one gill box enables a plurality of slivers to be carded and drafted by one spinning machine with different draft rates while performance of the machine can be improved and space for installation of the machine can be reduced.

While the invention has been described in its preferred embodiment, it is to be understood that the words which have been used are rather words of description than limitation, and that various changes and modification may be made within the purview of the appended claims without departing from the true scope and spirit of the invention in its broader aspects.

What is claimed is:

1. A sliver drawing apparatus, comprising:

feed rollers and front rollers substantially provided along a moving direction of a sliver for drawing said sliver while exerting compressive stresses thereto;

a first motor for driving said front rollers;

a second motor for driving said feed rollers;

first sensor means for detecting the rotational speeds of said first and second motors;

second sensor means for detecting an actual thickness of a portion of said sliver at a position upstream of said feed rollers in said moving direction and emitting a signal proportional thereto;

first electromagnetic brake means and second electromagnetic brake means for starting and stopping said first motor and said second motor, respectively; and control means including:

(a) memory means for storing said signal from said second sensor means, (b) means for emitting a signal from said memory means, based upon said signal from said second sensor means, after a lapse of time sufficient for said sliver portion to pass said feed rollers, said lapse of time being determined in response to factors including a speed ratio of said first and second motors and a distance between said second sensor means and said feed rollers, (c) means responsive to said signal from said emitting means for controlling the speed ratio of said first and second motors such that a sliver having a uniform thicknes emerges from said front rollers, and (d) brake control means for emitting signals to said first and second brake means for:

(i) simultaneously releasing said first and second brake means when a control voltage of said brake control means crosses a predetermined level during a start of rotation of said motors, and (ii) simultaneously activating said first and second brake means when the control voltage of said brake control means crosses a predetermined level at the end of rotation of said motors.

2. The apparatus of claim 1 wherein said first motor and said second motor are electric motors of the type whose rotational speed changes in accordance with a change in frequency of a power supply thereof.

3. The apparatus of claim 1 wherein said second sensor comprises at least a pair of measuring rollers and at least a position sensor.

4. The apparatus of claim 1 wherein said memory means is an analog memory.

5. The apparatus of claim 1 wherein said first sensor means comprise a first pulse generator and a second pulse generator for detecting the rotational speed of said first motor and said second motor respectively, and for generating pulse signals for said memory means.

6. The apparatus of claim 5 wherein said means for controlling the speed ratio comprises a first inverter and a second inverter for changing the frequency of signals to be applied to said first and said second motors.

7. The apparatus of claim 6 wherein said control means further comprises a feed-forward control signal generating means having a draft rate setting means, for generating said feed-forward control signal to be applied to said second inverter through an operational circuit for levelling the sliver in accordance with the output from said first pulse generator and said second pulse generator.

8. The apparatus of claim 1 including means for correcting said time lapse.

9. The apparatus of claim 1 wherein said control means comprises a microprocessor having a central processing unit (CPU), a read only memory (ROM) for storing control programs and various control data, a random access memory (RAM) for storing various data including data corresponding to the output from external elements and units, an input portion, and an input/output portion.

* * * * *

UNITED STATES PATENT AND TRADEMARK OFFICE

CERTIFICATE OF CORRECTION

PATENT NO. : 4,703,431

DATED : Oct. 27, 1987

INVENTOR(S) : Shizuka Sako, et al

It is certified that error appears in the above-identified patent and that said Letters Patent is hereby corrected as shown below:

On the Title Page, Item [73] Assignee: should read:

Chubu Seiko Cc., Ltd., Kasugai, Japan

Signed and Sealed this

Fifth Day of April, 1988

*Attest:*

*Attesting Officer*

DONALD J. QUIGG

*Commissioner of Patents and Trademarks*